US010818228B2

(12) United States Patent
Liu et al.

(10) Patent No.: US 10,818,228 B2
(45) Date of Patent: Oct. 27, 2020

(54) PIXEL CIRCUIT, METHOD FOR DRIVING PIXEL CIRCUIT AND DISPLAY PANEL

(71) Applicant: BOE Technology Group Co., Ltd., Beijing (CN)

(72) Inventors: Dongni Liu, Beijing (CN); Xiaochuan Chen, Beijing (CN); Minghua Xuan, Beijing (CN); Shengji Yang, Beijing (CN); Lei Wang, Beijing (CN); Li Xiao, Beijing (CN); Pengcheng Lu, Beijing (CN); Liang Chen, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 20 days.

(21) Appl. No.: 16/234,017

(22) Filed: Dec. 27, 2018

(65) Prior Publication Data

US 2019/0287459 A1 Sep. 19, 2019

(30) Foreign Application Priority Data

Mar. 16, 2018 (CN) ..... 2018 1 0216883

(51) Int. Cl.
*G09G 3/3233* (2016.01)
*G09G 3/20* (2006.01)

(52) U.S. Cl.
CPC ..... *G09G 3/3233* (2013.01); *G09G 3/2007* (2013.01); *G09G 2320/0626* (2013.01)

(58) Field of Classification Search
CPC ..... G09G 3/3233; G09G 3/2007; G09G 2320/0626
See application file for complete search history.

(56) References Cited

U.S. PATENT DOCUMENTS

2009/0303228 A1* 12/2009 Maeda ..... G09G 3/3446 345/214
2012/0038604 A1* 2/2012 Liu ..... G09G 3/3648 345/211

(Continued)

FOREIGN PATENT DOCUMENTS

CN 104732926 A 6/2015
CN 106991975 A 7/2017

(Continued)

OTHER PUBLICATIONS

First Office Action, including Search Report, for Chinese Patent Application No. 201810216883.8, dated Jun. 14, 2019, 20 pages.

*Primary Examiner* — Lixi C Simpson
(74) *Attorney, Agent, or Firm* — Westman, Champlin & Koehler, P.A.

(57) ABSTRACT

A pixel circuit, a method for driving a pixel circuit and a display panel are provided. The pixel circuit includes a control sub-circuit, a shunt sub-circuit, a light emitting sub-circuit and a latch sub-circuit, where the control sub-circuit is configured to output to the latch sub-circuit a data signal from a data signal line in response to a scan signal from a scan signal line; the latch sub-circuit is configured to latch a first level signal and a second level signal in response to the data signal and the scan signal, and output the second level signal to light emitting sub-circuit in response to a switch signal from a switch signal line, to enable the light emitting sub-circuit to emit light; and the shunt sub-circuit is configured to shunt, in response to a control signal from a control signal line, the second level signal input to the light emitting sub-circuit, to adjust a light emitting brightness of the light emitting sub-circuit.

13 Claims, 3 Drawing Sheets

(56) References Cited

U.S. PATENT DOCUMENTS

| | | | | |
|---|---|---|---|---|
| 2012/0154736 | A1* | 6/2012 | Nagasawa | G02F 1/133707 349/158 |
| 2017/0039934 | A1 | 2/2017 | Ma | |
| 2017/0264847 | A1 | 9/2017 | Aibara | |
| 2019/0180685 | A1 | 6/2019 | Zheng | |

FOREIGN PATENT DOCUMENTS

| | | | |
|---|---|---|---|
| CN | 106997747 | A | 8/2017 |
| WO | 2017/051154 | A1 | 3/2017 |

* cited by examiner

PIXEL CIRCUIT, METHOD FOR DRIVING PIXEL CIRCUIT AND DISPLAY PANEL

CROSS-REFERENCE TO RELATED APPLICATION

This application claims a priority to Chinese Patent Application No. 201810216883.8 filed on Mar. 16, 2018, the disclosures of which are incorporated in their entirety by reference herein.

TECHNICAL FIELD

The present disclosure relates to the field of display technology, and in particular to a pixel circuit, a method for driving a pixel circuit and a display panel.

BACKGROUND

In the gray-scale static latch module in the related art, the latch module latches the low level and the high level in response to the data signal of the data signal line. At the light-emitting stage, the gray scale display of the light-emitting diode is controlled by the switch signal of the switch signal line. However, in the pixel circuit of the current OLED display panel, the switch signal line may only control the light emitting diode to turn on and off so as to realize a simple gray scale display, but a multi-gray scale display cannot be realized.

SUMMARY

A pixel circuit is provided in the present disclosure, including a control sub-circuit, a shunt sub-circuit, a light emitting sub-circuit and a latch sub-circuit, the control sub-circuit is configured to output to the latch sub-circuit a data signal from a data signal line in response to a scan signal from a scan signal line;

the latch sub-circuit is configured to latch a first level signal and a second level signal in response to the data signal and the scan signal, and output the second level signal to light emitting sub-circuit in response to a switch signal from a switch signal line, to enable the light emitting sub-circuit to emit light; and the shunt sub-circuit is configured to shunt, in response to a control signal from a control signal line, the second level signal input to the light emitting sub-circuit, to adjust a light emitting brightness of the light emitting sub-circuit.

Optionally, the control sub-circuit includes a first switch component, a control electrode of the first switch component is coupled to the scan signal line, a first electrode of the first switch component is coupled to the data signal line, and a second electrode of the first switch component is coupled to the shunt sub-circuit, the latch sub-circuit and the light emitting sub-circuit.

Optionally, the shunt sub-circuit includes at least one switch component, and each of the at least one switch component is coupled to a capacitor.

Optionally, where the shunt sub-circuit includes a second switch component and a first capacitor, where a control electrode of the second switch component is coupled to the control signal line, the first electrode of the second switch component is coupled to the control sub-circuit, the light emitting sub-circuit and the latch sub-circuit, the second electrode of the second switch component is coupled to a first electrode of the first capacitor, and a second electrode of the first capacitor is coupled to a common voltage end.

Optionally, the shunt sub-circuit includes three third switch components connected in parallel and three second capacitors, each of the third switch components is coupled to a corresponding second capacitor of the three second capacitors, where a control electrode of each of the third switch components is coupled to the control signal line, a first electrode of each of the third switch components is coupled to the control sub-circuit, the light emitting sub-circuit and the latch sub-circuit, and a second electrode of each of the third switch components is coupled to a first electrode of a corresponding second capacitor of the three second capacitors, and a second electrode of each of the second capacitors is coupled to a common voltage end.

Optionally, the three second capacitors have different capacitance values.

Optionally, the shunt sub-circuit includes at least one switch component, each of the at least one switch component is coupled to a resistor.

Optionally, the shunt sub-circuit includes a fourth switch component and a first resistor, where a control electrode of the fourth switch component is coupled to the control signal line, a first electrode of the fourth switch component is coupled to the control sub-circuit, the light emitting sub-circuit and the latching sub-circuit, and a second electrode of the fourth switch component is coupled to a first electrode of the first resistor, and a second electrode of the first resistor is coupled to a common voltage end.

Optionally, the shunt sub-circuit includes three fifth switch components connected in parallel and three second resistors, each of the fifth switch components is coupled to a corresponding second resistor of the three second resistors, where a control electrode of each of the fifth switch components is coupled to the control signal line, a first electrode of each of the fifth switch components is coupled to the control sub-circuit, the light emitting sub-circuit and the latch sub-circuit, and a second electrode of each of the fifth switch components is coupled to a first electrode of a corresponding second resistor of the three second resistors, and a second electrode of each of the second resistors is coupled to a common voltage end.

Optionally, the three second resistors have different resistance values.

Optionally, the latch sub-circuit includes a sixth switch component, a seventh switch component, an eighth switch component, a ninth switch component and a tenth switch component and an eleventh switch component, where a control electrode of the sixth switch component is coupled to the scan signal line, a first electrode of the sixth switch component is coupled to a second electrode of the eighth switch component, a second electrode of the tenth switch component, a control electrode of the ninth switch component and a control electrode of the tenth switch component, and a second electrode of the sixth switch component is coupled to the light emitting sub-circuit, the control sub-circuit and the shunt sub-circuit;

a control electrode of the seventh switch component is coupled to the switch signal line, a first electrode of the seventh switch component is coupled to the light emitting sub-circuit, the control sub-circuit and the shunt sub-circuit, a second electrode of the seventh switch component is coupled to a second electrode of the ninth switch component, a second electrode of the eleventh switch component, a control electrode of the eighth switch component and a control electrode of the tenth switch component;

a first electrode of the eighth switch component is coupled to a second level;

a first electrode of the ninth switch component is coupled to the second level;

a first electrode of the tenth switch component coupled to a first level; and a first electrode of the eleventh switch component is coupled to the first level.

Optionally, the light emitting sub-circuit includes a light emitting diode, an anode of the light emitting sub-circuit is coupled to the control sub-circuit, the latch sub-circuit and the shunt sub-circuit, and a cathode of the light emitting sub-circuit is grounded.

A method for driving a pixel circuit is further provided in the present disclosure, where the pixel circuit includes a control sub-circuit, a shunt sub-circuit, a light emitting sub-circuit and a latch sub-circuit, where the control sub-circuit is configured to output to the latch sub-circuit a data signal from a data signal line in response to a scan signal from a scan signal line;

the latch sub-circuit is configured to latch a first level signal and a second level signal in response to the data signal and the scan signal, and output the second level signal to light emitting sub-circuit in response to a switch signal from a switch signal line, to enable the light emitting sub-circuit to emit light; and the shunt sub-circuit is configured to shunt, in response to a control signal from a control signal line, the second level signal input to the light emitting sub-circuit, to adjust a light emitting brightness of the light emitting sub-circuit;

the method includes:

at a storage stage, outputting, by the scan signal line, a first scan signal to the control sub-circuit;

the control sub-circuit electrically coupling the data signal line to the latch sub-circuit in response to the first scan signal;

outputting, by the data signal line, a data signal to the latch sub-circuit;

and latching, by the latch sub-circuit, a first level signal and a second level signal in response to the first scan signal, the data signal and a first switch signal output by the switch signal line;

at a light emitting stage, outputting a second scan signal by the scan signal line, and outputting a second switch signal by the switch signal line;

outputting, by the switch signal line, a second switch signal to the latch sub-circuit;

outputting, by the latch sub-circuit, a second level signal to the light emitting sub-circuit in response to the second switch signal, to enable the light emitting sub-circuit to emit light;

outputting, by the control signal line, a control signal to the shunt sub-circuit; and shunting, by the shunt sub-circuit, the second level signal input to the light emitting sub-circuit, to adjust the light emitting brightness of the light emitting sub-circuit.

A display panel is further provided in the present disclosure, including the above pixel circuit.

BRIEF DESCRIPTION OF THE DRAWINGS

The embodiments of the present disclosure will be further described in detail below in conjunction with drawings.

DETAILED DESCRIPTION

Figure 1:
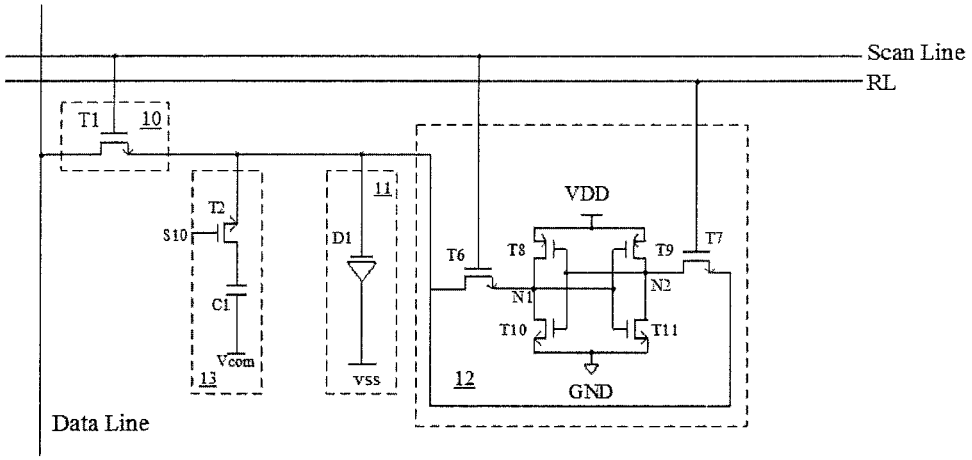
FIG. 1 is a schematic view of a pixel circuit in some embodiments of the present disclosure.

In order to make the present disclosure more clearly, the present disclosure will be further described in detail below in conjunction with the preferred embodiments and drawings. In the following detailed description, numerous specific details are set forth. However, one skilled in the art should understand that one or more embodiments can be implemented without specific details. In other instances, well-known structures and devices are shown in the drawings in the drawings. It should be noted that the word "comprising" does not exclude other components or steps. The word "a" or "an" does not exclude a plurality.

In the pixel circuit in the related art, when the pixel circuit is in the storage stage, the control sub-circuit switches on the data signal line, the latch sub-circuit and the light emitting sub-circuit in response to the scan signal of the second level of the scan signal line. At this time, the data signal output by the data signal line is at a first level, the light emitting sub-circuit is not turned on, and the latch sub-circuit latches the first level and the second level in response to the data signal of the first level, and at the same time, the latch sub-circuit inputs a first level signal to the light emitting sub-circuit in response to the scan signal of the scan signal line, and the light emitting sub-circuit is not turned on and does not emit light.

When the pixel circuit is in the light emitting stage, the scan signal becomes the first level, the switch signal of the switch signal line is the second level, and the latch sub-circuit inputs the second level to the light emitting sub-circuit in response to the scan signal and the switch signal, so that the sub-circuit emits light, to realize two simple gray scale display of light and dark. The higher gray scale display is difficult to realize due to the space limitation of the pixel circuit layout and the characteristics of the latch sub-circuit.

In view of this, a pixel circuit is provided in some embodiments of the present disclosure. FIG. 1 is a schematic view of a pixel circuit in some embodiments of the present disclosure.

As shown in FIG. 1, the pixel circuit of this embodiment includes a control sub-circuit 10, a shunt sub-circuit 13, a light emitting sub-circuit 11, and a latch sub-circuit 12. The control sub-circuit 10 is coupled to the scan signal line Scan Line, the data signal line Data Line, the shunt sub-circuit 13, the light emitting sub-circuit 11 and the latch sub-circuit 12. The shunt sub-circuit 13 is coupled to the control signal line, the control sub-circuit 10, the light emitting sub-circuit 11 and the latch sub-circuit 12. The light emitting sub-circuit 11 is coupled to the control sub-circuit 10, the shunt sub-circuit 13 and the latch sub-circuit 12. The latch sub-circuit 12 is coupled to the scan signal line Scan Line, the switch signal line RL, the control sub-circuit 10, the light emitting sub-circuit 11 and the shunt sub-circuit 13.

The control sub-circuit 10 may output a data signal from the data signal line Data Line to the latch sub-circuit 12 in response to a scan signal from the scan signal line Scan Line, the latch sub-circuit 12 latches the first level signal and the second level signal in response to the data signal and the scan signal, and outputs the second level signal to the light emitting sub-circuit 11 in response to the switch signal of the switch signal line RL to enable the light emitting sub-circuit 11 to emit light, the shunt sub-circuit 13 shunts, in response to a control signal of the control signal line, the second level signal input to the light emitting sub-circuit 11, to adjust the light emitting brightness of the light emitting sub-circuit 11.

In some embodiments of the present disclosure, the control sub-circuit 10 may include a first transistor T1 (in some embodiments, T1 is an N-type MOS transistor), and a control electrode of the first transistor T1 is coupled to the scan signal line Scan Line, a first electrode thereof is coupled to the data signal line Data Line, and a second electrode thereof is coupled to the shunt sub-circuit 13, the latch sub-circuit 12 and the light emitting sub-circuit 11.

The first transistor T1 is turned on in response to the scan signal of the scan signal line Scan Line to electrically couple the data signal line Data Line to the light emitting sub-circuit 11, the latch sub-circuit 12 and the shunt sub-circuit 13, so that the latch sub-circuit 12 latches the first level signal and the second level signal in response to the data signal of the data signal line Data Line.

The shunt sub-circuit 13 shunts, in response to the control signal of the control signal line, the second level signal input to the light emitting sub-circuit 11, to reduce the current flowing into the light emitting sub-circuit 11, so as to adjust the light emitting brightness of the light emitting sub-circuit 11 and achieve the multi-gray scale display.

In some embodiments of the present disclosure, the shunt sub-circuit 13 includes at least one switch component, each of the at least one switch component is coupled to a capacitor. For example, the shunt sub-circuit 13 includes a second transistor T2 (in some embodiments, T2 is an N-type MOS transistor) and a first capacitor C1. A control electrode of the second transistor T2 is coupled to the control signal line S10 configured to output the control signal, and a first electrode thereof is coupled to the control sub-circuit 10, the light-emitting sub-circuit 11 and the latch sub-circuit 12, and a second electrode thereof is coupled to a first electrode of the first capacitor C1, a second electrode of the first capacitor C1 is coupled to the common voltage end Vcom.

The latch sub-circuit 12 latches the first level and the second level in response to the data signal and the scan signal, and outputs a second level signal to the light emitting sub-circuit 11 in response to the switch signal, so as to enable the light emitting sub-circuit 11 to emit light.

In some embodiments of the present disclosure, the latch sub-circuit 12 may include a sixth transistor T6, a seventh transistor T7, an eighth transistor T8, a ninth transistor T9, a tenth transistor T10, and an eleventh transistor T11. For example, the eighth transistor T8 and the ninth transistor T9 are P-type MOS transistors, and the sixth transistor T6, the seventh transistor T7, the tenth transistor T10 and the eleventh transistor T11 are N-type MOS transistors.

A control electrode of the sixth transistor T6 is coupled to the scan signal line Scan Line, the first electrode thereof is coupled to a second electrode of the eighth transistor T8, a second electrode of the tenth transistor T10, a control electrode of the transistor T9 and a control electrode of the tenth transistor T10, and the second electrode thereof is coupled to the light emitting sub-circuit 11, the control sub-circuit 10 and the shunt sub-circuit 13. A control electrode of the seventh transistor T7 is coupled to the switch signal line RL, and a first electrode thereof is coupled to the light emitting sub-circuit 11, the control sub-circuit 10 and the shunt sub-circuit 13, and a second electrode thereof is coupled to a second electrode of the ninth transistor T9, a second electrode of the eleventh transistor T11, a control electrode of the eighth transistor T8 and a control electrode of the tenth transistor T10. A first electrode of the eighth transistor T8 is coupled to a second level. A first electrode of the ninth transistor T9 is coupled to the second level. A first electrode of the tenth transistor T10 is coupled to the first level. A first electrode of the eleventh transistor T11 is coupled to the first level.

The latch sub-circuit 12 latches the first level and the second level. For example, the first level latched by the latch sub-circuit 12 is the level of the GND end, and the second level latched is the level of the VDD end. When the latch sub-circuit 12 electrically couples the second electrode of the sixth transistor T6 to the light emitting sub-circuit 11 in response to the second level of the scan signal line Scan Line and the first level of the switch signal line RL, the latch sub-circuit 12 outputs the first level to the light emitting sub-circuit 11, the light emitting sub-circuit 11 does not emit light. When the latch sub-circuit 12 electrically couples the first electrode of the seventh transistor T7 to the light emitting sub-circuit 11 in response to the first level of the scan signal line Scan Line and the second level of the switch signal line RL, the latch sub-circuit 12 outputs the second level to the light emitting sub-circuit 11 to enable the light emitting sub-circuit 11 to emit light.

Specifically, when the seventh transistor T7 is turned on in response to the switch signal line RL at the second level, the first electrode of the seventh transistor T7 is electrically coupled to the input end of the light emitting sub-circuit 11 and the shunt sub-circuit 13, and the light emitting sub-circuit 11 emits light in response to the second level output by the latch sub-circuit 12. The control electrode of the second transistor T2 of the shunt sub-circuit 13 is coupled to the control signal line S10, and the second transistor T2 may electrically couple the first capacitor C1 and the first electrode of the seventh transistor T7 in response to the control signal of the control signal line S10, so as to shunt a part of the current input to the light-emitting sub-circuit 11 from the first-electrode input of the seventh transistor T7 to the first capacitor C1, so that the current input to the light-emitting sub-circuit 11 is reduced, and thus the luminance of the light-emitting sub-circuit 11 is reduced, thereby realizing a multi-gray scale display.

In some embodiments of the present disclosure, the light emitting sub-circuit 11 may be a light emitting diode D1, and an anode thereof is coupled to the control sub-circuit 10, the latch sub-circuit 12 and the shunt sub-circuit 13, and the cathode thereof is grounded to VSS. Optionally, when the pixel circuit is applied in the display panel, the display panel includes a plurality of sub-pixels, where each sub-pixel may correspond to one of the light-emitting sub-circuits 11, and the light-emitting brightness of the certain light-emitting sub-circuit 11 corresponds to the gray value of the sub-pixel.

Figure 2:
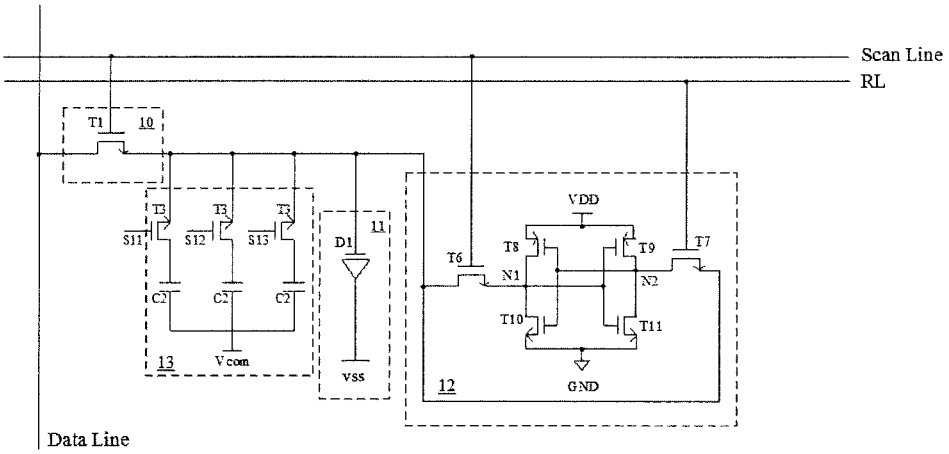
FIG. 2 is a schematic view of a pixel circuit in some embodiments of the present disclosure.

In some embodiments of the present disclosure, as shown in FIG. 2, the shunt sub-circuit 13 includes three transistors T3 connected in parallel (in some embodiments, the third transistor T3 is an NMOS transistor), and each of the third transistors T3 is coupled to a second capacitor C2.

The control electrode of each of the third transistors T3 is coupled to the control signal lines (S11, S12, S13), the first electrodes thereof are coupled to the control sub-circuit 10, the light-emitting sub-circuit 11 and the latch sub-circuit 12, and the second electrode thereof are coupled to the first electrode of the second capacitor C2, the second electrode of the second capacitor C2 is coupled to the common voltage end Vcom.

The three transistors may be controlled to be turned on and off by inputting different control signals thereto respectively, so as to electrically couple or not couple the second capacitors C2 in the shunt sub-circuit 13 to the latch sub-circuit 12, to electrically couple one or more of the three second capacitors C2 to the pixel circuit, so that the light emitting sub-circuit 11 may emit light at different brightness thereby realizing a display with a higher gray scale.

In some embodiments of the present disclosure, the three second capacitors C2 in the shunt sub-circuit 13 may have different capacitance values, so that when any two of the three capacitors are coupled to the pixel circuit, the shunting effect may be varied, thereby realizing a higher and a more flexible gray scale display.

Figure 3:
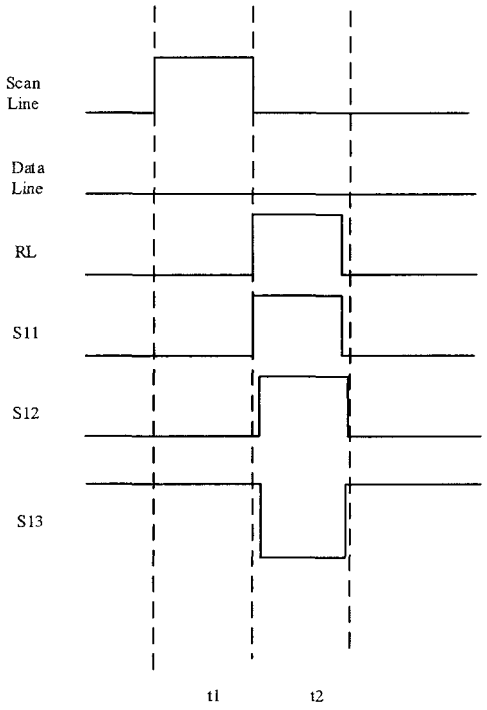
FIG. 3 is a signal timing sequence diagram of the pixel circuit shown in FIG. 2 in some embodiments of the present disclosure.

A method for driving a pixel circuit is further provided in some embodiments of the present disclosure. FIG. 3 is a signal timing sequence diagram of the pixel circuit in some embodiments of the present disclosure, the method includes:

At a Storage Stage t1:

the scan signal line Scan Line outputs a first scan signal, the data signal line Data Line outputs a data signal, and the switch signal line RL outputs a first switch signal. For example, the first scan signal output by the scan signal line Scan Line is at a high level, the data signal output by the data signal line Data Line is low level, the first switch signal output by the switch signal line RL is at a low level, the control signal output by the control signal line S11 is at a low level, the control signal output by the control signal line S12 is at a low level, and the control signal output by the control signal line S13 is at a high level;

the scan signal line Scan Line outputs a first scan signal of a high level to the control sub-circuit 10, the control sub-circuit 10 electrically couples the data signal line Data Line to the latch sub-circuit 12 in response to the first scan signal, and the data signal line Data Line outputs the data signal of the first level to the latch sub-circuit 12, and the latch sub-circuit 12 latches the first level signal and the second level signal in response to the first scan signal, the data signal, and the first switch signal of the low level.

In some embodiments of the present disclosure, the first transistor T1 of the control sub-circuit 10 is turned on in response to the first scan signal of the high level, and the data signal of the low level is input to the shunt sub-circuit 13 and latch sub-circuit 12 and lighting sub-circuit 11 via the first transistor T1. The data signal of the low-level cannot reach the turn-on voltage of the light-emitting diode of the light-emitting sub-circuit 11, and the light-emitting diode is turned off and does not emit light.

The sixth transistor T6 of the latch sub-circuit 12 is turned on in response to the first scan signal, and the seventh transistor T7 is turned off in response to the switch signal. Therefore, the second electrode of the sixth transistor T6 is coupled to the second electrode of the first transistor T1, the sixth transistor T6 is turned on, and the first electrode of the sixth transistor T6 and the second electrode of the first transistor T1 are both at a low level, the ninth transistor T9 is turned on, the second node is turned to the high level; the tenth transistor T10 is turned on, the level of the first node is kept at the low level of the GND end; the eighth transistor T8 and the eleventh transistor T11 are turned off, and the level of the second node is maintained at the high level of the VDD end. Thus, the first node and the second node of the latch sub-circuit 12 latch low level and high level.

At a Light Emitting Stage t2:

the scan signal line Scan Line outputs a second scan signal, and the switch signal line RL outputs a second switch signal. The level of the second scan signal is opposite to the first scan signal, and the level of the second switch signal is opposite to the first switch signal. Therefore, the second scan signal output by the scan signal line Scan Line is at a low level, the second switch signal output by the switch signal line RL is at a high level, and the control signal output by the control signal line S11 is at a high level, the control signal output by the control signal line S12 is at a high level, and the control signal output by the control signal line S13 is at a high level.

The second switch signal of the high level is input to the latch sub-circuit 12, and the latch sub-circuit 12 outputs the second level signal to the light emitting sub-circuit 11 so that the light emitting sub-circuit 11 emits light.

Specifically, the second scan signal of the scan signal line Scan Line is at a low level, the first transistor T1 and the sixth transistor T6 are turned off; the second switch signal of the switch signal line RL is at a high level, and the seventh transistor T7 is turned on. The high level latched by the second node N2 is input to the light emitting sub-circuit 11, and the light emitting diode D1 of the light emitting sub-circuit 11 is turned on to emit light.

The control signal line (S11, S12, S13) output a control signal to the shunt sub-circuit, and the shunt sub-circuit shunts the second level signal input to the input lighting sub-circuit to adjust the light-emitting brightness of the lighting emitting sub-circuit.

Specifically, the control signal of the control signal line S11 becomes a high level, the third transistor T3 is turned on, the control signal of the control signal line S12 becomes a high level, the third transistor T3 is turned on, and the control signal of the control signal line S13 becomes a low level, the third transistor T3 is turned off, so that the high-level latched by the second node N2 of the latch sub-circuit is input to light-emitting sub-circuit 11 and the shunt sub-circuit 13, a part of the current input to light-emitting sub-circuit 11 is shunted to the control shunt branches S11 and S12 of the shunt sub-circuit 13, and the current input to light-emitting sub-circuit 11 is shunted at different degrees according to the capacitance of the second capacitor, the input current of the light-emitting sub-circuit 11 becomes smaller, and the light-emitting brightness of the light-emitting diode D1 is reduced, thereby adjusting the light emitting brightness of the light-emitting diode D1. By the control signals, the second capacitor of respective shunting branches of the shunt sub-circuit 13 may be controlled to be coupled or not coupled to the second node N2, so as to control the shunting of the shunt sub-circuit 13, thereby enabling the light-emitting diode to display at different gray scales. The levels of the control signals output by the control signal lines S11, S12 and S13 may be determined based on the required gray scale of the light emitting sub-circuit.

Further, at the storage stage t1, if the data signal output by the data signal line Data Line is at a high level, the level signals latched by the first node N1 and the second node N2 of the latch sub-circuit 13 are opposite to those in the above embodiment. That is, the first node N1 is kept at a high level, and the second node N2 is kept at a low level. At this time, the level of the data signal reaches the turn-on voltage of the switching transistor in the latch sub-circuit, so that the switching transistor in the latch sub-circuit is normally turned on, but the turn-on voltage of the light-emitting diode D1 of the light-emitting sub-circuit 12 is not reached. Therefore, at the storage stage t1, the light emitting diode D1 does not emit light. At the light emitting stage t2, the low-level of the second node N2 is input to the light-emitting sub-circuit 12, and the turn-on voltage of the light-emitting diode D1 of the light-emitting sub-circuit 12 is still not reached, and the light-emitting diode D1 does not emit light.

It should be noted that, the level of the data signal output by the data signal line Data Line before and after the storage stage t1 is related to the light emitting state of the sub-pixels at the previous and subsequent rows scanned by the scan signal line Scan Line, and the level of the data signal may be determined as needed.

It should be noted that those skilled in the art may understand that the high and low levels of various signals are matched with the type of the transistor to achieve the corresponding function. The high and low-level, N-type transistors and P-type transistors of the above embodiments are merely examples, and the opposite cooperation is also within the scope of the present disclosure. For example, the P-type transistor is turned on and needs to be matched with a low-level signal, so that the N-type Transistor may be turned on by a high level signal.

In addition, the transistor in some embodiments of the present disclosure may be a field effect transistor, an enhanced field effect transistor or a depletion field effect transistor. For example, the transistor low-temperature poly-silicon TFT may reduce the manufacturing cost and product power consumption, which has faster electron mobility and a smaller film circuit area and improves display resolution and stability.

In addition, the first electrode of the transistor in some embodiments of the present disclosure may be a source, and the second electrode is a drain, or vice versa. The disclosure is not limited thereto, and may be appropriately selected according to the type of the transistor.

Figure 4:
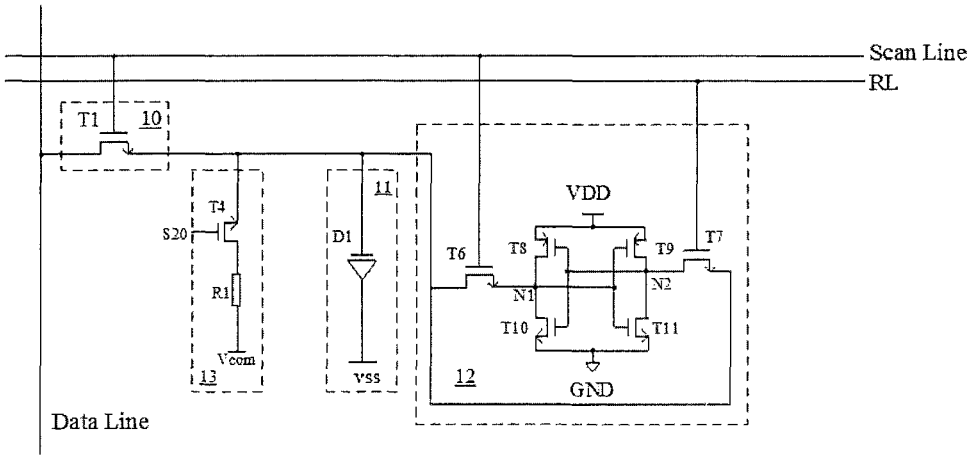
FIG. 4 is a schematic view of a pixel circuit in some embodiments of the present disclosure.

As shown in FIG. 4, the shunt sub-circuit 13 may include a fourth transistor T4 and a first resistor R1.

The control electrode of the fourth transistor T4 (in this embodiment, the fourth transistor T4 is an NMOS transistor) is coupled to the control signal line S20 of the input control signal, and the first electrode thereof is coupled to the control sub-circuit 10, the light emitting sub-circuit 11 and the latch sub-circuit 12, and the second electrode thereof is coupled to the first electrode of the first resistor R1. The second electrode of the first resistor R1 is coupled to the common voltage end Vcom.

In response to the switch signal of the second level, the seventh transistor T7 is turned on, and the second level signal of the first electrode of the seventh transistor T7 is input to the light emitting sub-circuit 11 to enable the light emitting diode D1 to emit light. The four-transistor T4 is controlled to be turned on and off in response to a control signal, so that a part of the current input to the light-emitting sub-circuit 11 may be shunted to the first resistor R1 of the shunt sub-circuit 13, so as to adjust the size of the current flowing into the light-emitting diode D1 to realize a multi-gray display.

Figure 5:
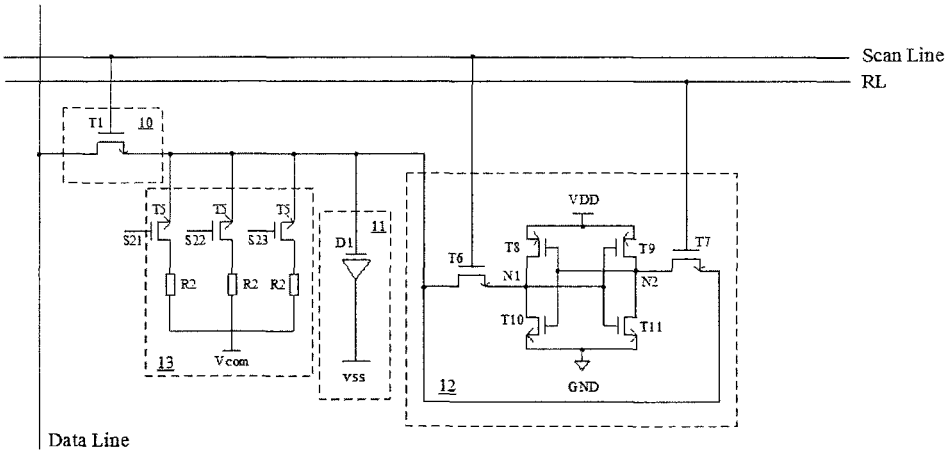
FIG. 5 is a schematic view of a pixel circuit in some embodiments of the present disclosure.

In some embodiments of the present disclosure, as shown in FIG. 5, the shunt sub-circuit 13 includes three fifth transistors T5 connected in parallel (in the embodiment, the fifth transistor T5 is an NMOS transistor), each of the fifth transistors T5 is coupled to a second resistor R2.

The control electrode of each fifth transistor T5 is coupled to the control signal line (S21, S22, S23), and the first electrode thereof is coupled to the control sub-circuit 10, the light emitting sub-circuit 11 and the latch sub-circuit 12, and the second electrode thereof is coupled to the first electrode of the second resistor R2, the second electrode of the second resistor R2 is coupled to the common voltage end Vcom.

The three fifth transistors T5 may be controlled to be turned on and off by inputting different control signals thereto respectively, so as to electrically couple or not couple the second resistors R2 in the shunt sub-circuit 13 to the latch sub-circuit 12, to electrically couple one or more of the three second resistors R2 to the pixel circuit, so that the light emitting sub-circuit 11 may emit light at different brightness thereby realizing a display with a higher gray scale.

In some embodiments of the present disclosure, the three resistors R2 in the shunt sub-circuit 13 may have different resistance values, so that when any two of the three resistors R2 are coupled to the pixel circuit, the shunting effect may be varied, thereby realizing a higher and a more flexible gray scale display.

The shunting sub-circuit in the present disclosure is not limited to include the first capacitor, the second capacitor and the first resistor, and may also have other components having the shunting function to shunt the current input to the light emitting sub-circuit.

A display panel is further provide in some embodiments of the present disclosure, including the pixel circuits as described above. The display panel can be an LCD display panel or an OLED display panel, and the display panel can be used for any product or component having a display function, such as a mobile phone, a tablet computer, a television, a display, a notebook computer, a digital photo frame, a navigator, and the like.

The above are merely some embodiments of the present disclosure. A person skilled in the art may make further modifications and improvements without departing from the principle of the present disclosure, and these modifications and improvements shall also fall within the scope of the present disclosure.

What is claimed is:

1. A pixel circuit, comprising a control sub-circuit, a shunt sub-circuit, a light emitting sub-circuit and a latch sub-circuit, wherein the control sub-circuit is configured to output to the latch sub-circuit a data signal from a data signal line in response to a scan signal from a scan signal line;

the latch sub-circuit is configured to latch a first level signal and a second level signal in response to the data signal and the scan signal, and output the second level signal to light emitting sub-circuit in response to a switch signal from a switch signal line, to enable the light emitting sub-circuit to emit light; and the shunt sub-circuit is configured to shunt, in response to a control signal from a control signal line, the second level signal input to the light emitting sub-circuit, to adjust a light emitting brightness of the light emitting sub-circuit;

wherein the control sub-circuit comprises a first switch component, a control electrode of the first switch component is coupled to the scan signal line, a first electrode of the first switch component is coupled to the data signal line, and a second electrode of the first switch component is coupled to the shunt sub-circuit, the latch sub-circuit and the light emitting sub-circuit.

2. The pixel circuit according to claim 1, wherein the shunt sub-circuit comprises at least one switch component, and each of the at least one switch component is coupled to a capacitor.

3. The pixel circuit according to claim 2, wherein the shunt sub-circuit comprises a second switch component and a first capacitor, wherein a control electrode of the second switch component is coupled to the control signal line, the first electrode of the second switch component is coupled to the control sub-circuit, the light emitting sub-circuit and the latch sub-circuit, the second electrode of the second switch component is coupled to a first electrode of the first capacitor, and a second electrode of the first capacitor is coupled to a common voltage end.

4. The pixel circuit according to claim 2, wherein the shunt sub-circuit comprises three third switch components connected in parallel and three second capacitors, each of the third switch components is coupled to a corresponding second capacitor of the three second capacitors, wherein a control electrode of each of the third switch components is coupled to the control signal line, a first electrode of each of the third switch components is coupled to the control sub-circuit, the light emitting sub-circuit and the latch sub-circuit, and a second electrode of each of the third switch components is coupled to a first electrode of a corresponding second capacitor of the three second capacitors, and a second electrode of each of the second capacitors is coupled to a common voltage end.

5. The pixel circuit according to claim 4, wherein the three second capacitors have different capacitance values.

6. The pixel circuit according to claim 1, wherein the shunt sub-circuit comprises at least one switch component, each of the at least one switch component is coupled to a resistor.

7. The pixel circuit according to claim 6, wherein the shunt sub-circuit comprises a fourth switch component and a first resistor, wherein a control electrode of the fourth switch component is coupled to the control signal line, a first electrode of the fourth switch component is coupled to the control sub-circuit, the light emitting sub-circuit and the latching sub-circuit, and a second electrode of the fourth switch component is coupled to a first electrode of the first resistor, and a second electrode of the first resistor is coupled to a common voltage end.

8. The pixel circuit according to claim 6, wherein the shunt sub-circuit comprises three fifth switch components connected in parallel and three second resistors, each of the fifth switch components is coupled to a corresponding second resistor of the three second resistors, wherein a control electrode of each of the fifth switch components is coupled to the control signal line, a first electrode of each of the fifth switch components is coupled to the control sub-circuit, the light emitting sub-circuit and the latch sub-circuit, and a second electrode of each of the fifth switch components is coupled to a first electrode of a corresponding second resistor of the three second resistors, and a second electrode of each of the second resistors is coupled to a common voltage end.

9. The pixel circuit according to claim 8, wherein the three second resistors have different resistance values.

10. The pixel circuit according to claim 1, wherein the latch sub-circuit comprises a sixth switch component, a seventh switch component, an eighth switch component, a ninth switch component and a tenth switch component and an eleventh switch component, wherein a control electrode of the sixth switch component is coupled to the scan signal line, a first electrode of the sixth switch component is coupled to a second electrode of the eighth switch component, a second electrode of the tenth switch component, a control electrode of the ninth switch component and a control electrode of the tenth switch component, and a second electrode of the sixth switch component is coupled to the light emitting sub-circuit, the control sub-circuit and the shunt sub-circuit;

a control electrode of the seventh switch component is coupled to the switch signal line, a first electrode of the seventh switch component is coupled to the light emitting sub-circuit, the control sub-circuit and the shunt sub-circuit, a second electrode of the seventh switch component is coupled to a second electrode of the ninth switch component, a second electrode of the eleventh switch component, a control electrode of the eighth switch component and a control electrode of the tenth switch component;

a first electrode of the eighth switch component is coupled to a second level;

a first electrode of the ninth switch component is coupled to the second level;

a first electrode of the tenth switch component coupled to a first level; and a first electrode of the eleventh switch component is coupled to the first level.

11. The pixel circuit according to claim 1, wherein the light emitting sub-circuit comprises a light emitting diode, an anode of the light emitting sub-circuit is coupled to the control sub-circuit, the latch sub-circuit and the shunt sub-circuit, and a cathode of the light emitting sub-circuit is grounded.

12. A display panel comprising the pixel circuit according to claim 1.

13. A method for driving a pixel circuit, wherein the pixel circuit comprises a control sub-circuit, a shunt sub-circuit, a light emitting sub-circuit and a latch sub-circuit, wherein the control sub-circuit is configured to output to the latch sub-circuit a data signal from a data signal line in response to a scan signal from a scan signal line;

the latch sub-circuit is configured to latch a first level signal and a second level signal in response to the data signal and the scan signal, and output the second level signal to light emitting sub-circuit in response to a switch signal from a switch signal line, to enable the light emitting sub-circuit to emit light; and the shunt sub-circuit is configured to shunt, in response to a control signal from a control signal line, the second level signal input to the light emitting sub-circuit, to adjust a light emitting brightness of the light emitting sub-circuit;

the method comprises:

at a storage stage, outputting, by the scan signal line, a first scan signal to the control sub-circuit;

the control sub-circuit electrically coupling the data signal line to the latch sub-circuit in response to the first scan signal;

outputting, by the data signal line, a data signal to the latch sub-circuit; and latching, by the latch sub-circuit, a first level signal and a second level signal in response to the first scan signal, the data signal and a first switch signal output by the switch signal line;

at a light emitting stage, outputting a second scan signal by the scan signal line, and outputting a second switch signal by the switch signal line;

outputting, by the switch signal line, a second switch signal to the latch sub-circuit;

outputting, by the latch sub-circuit, a second level signal to the light emitting sub-circuit in response to the second switch signal, to enable the light emitting sub-circuit to emit light;

outputting, by the control signal line, a control signal to the shunt sub-circuit; and shunting, by the shunt sub-circuit, the second level signal input to the light emitting sub-circuit, to adjust the light emitting brightness of the light emitting sub-circuit.

* * * * *